US007453429B2

(12) United States Patent
Chang et al.

(10) Patent No.: US 7,453,429 B2
(45) Date of Patent: Nov. 18, 2008

(54) VIEWING-ANGLE ADJUSTABLE LIQUID CRYSTAL DISPLAY AND METHOD FOR ADJUSTING VIEWING-ANGLE OF THE SAME

(75) Inventors: Chih-Ming Chang, Jhongli (TW); Meng-Chang Tsai, Chiayi (TW)

(73) Assignee: AU Optronics Corp., Hsin-Chu (TW)

( * ) Notice: Subject to any disclaimer, the term of this patent is extended or adjusted under 35 U.S.C. 154(b) by 682 days.

(21) Appl. No.: 11/086,643

(22) Filed: Mar. 22, 2005

(65) Prior Publication Data

US 2006/0109224 A1 May 25, 2006

(30) Foreign Application Priority Data

Nov. 22, 2004 (TW) ..... 93135910 A

(51) Int. Cl.
*G09G 3/36* (2006.01)

(52) U.S. Cl. ..... 345/89

(58) Field of Classification Search ..... 345/55, 345/89, 690, 694, 698
See application file for complete search history.

(56) References Cited

U.S. PATENT DOCUMENTS

| | | | | | |
|---|---|---|---|---|---|
| 5,717,474 | A * | 2/1998 | Sarma | 349/85 |
| 5,777,700 | A * | 7/1998 | Kaneko et al. | 349/39 |
| 5,847,688 | A * | 12/1998 | Ohi et al. | 345/98 |
| 5,877,737 | A * | 3/1999 | Kim et al. | 345/89 |
| 5,877,829 | A | 3/1999 | Okamoto et al. | 349/74 |
| 5,936,596 | A * | 8/1999 | Yoshida et al. | 345/9 |
| 6,239,853 | B1 | 5/2001 | Winker et al. | 349/117 |
| 6,398,370 | B1 | 6/2002 | Chiu et al. | 359/613 |
| 6,445,434 | B2 | 9/2002 | Takato et al. | 349/123 |
| 6,801,220 | B2 * | 10/2004 | Greier et al. | 345/694 |
| 7,084,845 | B2 * | 8/2006 | Hong | 345/89 |
| 2003/0146893 | A1 * | 8/2003 | Sawabe | 345/89 |
| 2004/0061711 | A1 * | 4/2004 | Kurumisawa et al. | 345/698 |
| 2004/0164943 | A1 * | 8/2004 | Ogawa et al. | 345/92 |
| 2004/0207594 | A1 * | 10/2004 | Kubo | 345/100 |
| 2005/0184944 | A1 * | 8/2005 | Miyata et al. | 345/89 |
| 2005/0286000 | A1 * | 12/2005 | Tsai et al. | 349/119 |
| 2006/0103615 | A1 * | 5/2006 | Shih et al. | 345/88 |
| 2006/0145976 | A1 * | 7/2006 | Tsai et al. | 345/87 |
| 2007/0146261 | A1 * | 6/2007 | Matsushima et al. | 345/87 |
| 2008/0068314 | A1 * | 3/2008 | Hsieh et al. | 345/87 |

* cited by examiner

*Primary Examiner*—Sumati Lefkowitz
*Assistant Examiner*—Rodney Amadiz
(74) *Attorney, Agent, or Firm*—Thomas, Kayden, Horstemeyer & Risley

(57) ABSTRACT

A viewing-angle adjustable liquid crystal display includes a display panel and a data driver. The display panel includes several pixel units. Each pixel unit has a first sub-pixel and a second sub-pixel. The data driver provides a first driving voltage and a second driving voltage, respectively, to the first sub-pixel and the second sub-pixel. When the liquid crystal display is operated in the wide viewing-angle mode, the first and the second driving voltage of each pixel unit are substantially equal to a pixel voltage, while when the liquid crystal display is operated in the narrow viewing-angle mode, the first driving voltages corresponding to one portion of the pixel units and the second driving voltages corresponding to the other portion of the pixel units are substantially equal to a gray-level voltage.

7 Claims, 11 Drawing Sheets

VIEWING-ANGLE ADJUSTABLE LIQUID CRYSTAL DISPLAY AND METHOD FOR ADJUSTING VIEWING-ANGLE OF THE SAME

This application claims the benefit of Taiwan application Serial No. 93135910, filed Nov. 22, 2004, the subject matter of which is incorporated herein by reference.

BACKGROUND OF THE INVENTION

1. Field of the Invention

The invention relates in general to a viewing-angle adjustable liquid crystal display and method for adjusting viewing angle of same, and more particularly to a viewing-angle adjustable liquid crystal display, which can provide the required viewing-angle mode for the user by electrical signal switching, and method for adjusting viewing angle of same.

2. Description of the Related Art

As technology makes progress, consumers have more opportunities of using mobile devices equipped with liquid crystal displays, such as mobile phones or notebook computers, in public regions. As using the mobile device in a public region, the consumer often need the mobile device to have a viewing-angle adjustable display so as to keep the displayed images secret. At present, there are three kinds of well-known liquid crystal display viewing-angle control methods.

FIG. 1 is a schematic diagram of using shutter structure to adjust the liquid crystal display viewing-angle. Referring to FIG. 1, the shutter structure 110 is disposed in front of the liquid crystal display 100 and has the shutters arranged in parallel. By adjusting the height h of the shutter structure 110 and the distance I between two adjacent shutters, the light L emitted by the display 100 can be restricted to reach eyes of the observers at some specific viewing-angles. Therefore, only within the viewing angle region spreading the angle θ as shown in the figure, the light L can pass the absorbing materials 110 and the observer at these viewing angles can thus see the images on the display 100 while the light L emitted beyond the viewing-angle region of the angle θ, will be absorbed by the absorbing materials 110.

However, the viewing-angle control method has the following disadvantages. The shutter structure 110, as used, should be additionally configured at the exterior of the display, thereby causing the inconvenience in usage. Since a part of the light L is absorbed by the shutter structure 110, the display luminance will be lowered down at least a half. Moreover, the shutter structure 110 can only provide a left side viewing-angle mode or a right side viewing-angle mode, which will not meet the user's requirement of various view-angle modes; for example, only the users at front view and the left-side view can observe the displayed images.

FIG. 2A and FIG. 2B are schematic diagrams of using a light scattering device to adjust the liquid crystal display viewing-angle. The light scattering device 210, such as a polymer dispersed liquid crystal (PDLC) layer, in which light scattering features can be adjusted, is disposed between the parallel backlight (Lb) device (not shown in the figure) and the liquid crystal cell 200. By adjusting the voltage applied to the light scattering device 210, the narrow viewing-angle mode and the wide viewing-angle mode can be provided. As shown in FIG. 2A, under the narrow viewing-angle mode, the light scattering device 210 is in the power on state, and appears transparent so that the backlight Lb is maintained parallel after passing the light scattering device 210 to reach the liquid crystal cell 200. Therefore, only the front view observer can see the displayed images. As shown in FIG. 2B, under the wide viewing-angle mode, the light scattering device 210 is in the power off state, the backlight Lb is scattered to form the scattering light Ls and enter the liquid crystal layer 200 so that the observers at every viewing angle can see the displayed images.

However, this viewing angle control method has the following disadvantages. When the light scattering device 210 is switched to the power on state, a part of the backlight Lb will be reflected as passing the light scattering device 210, thereby reducing the luminance of the liquid crystal panel 200. In addition, as the above-mentioned example, this viewing angle control method can only provide the narrow viewing angle mode for front view observers, but not for the user at any other viewing angle, thereby reducing the available options in viewing-angle adjusting.

FIG. 3A and FIG. 3B are schematic diagrams of controlling display viewing-angles by using an extra alignment layer. By adjusting the rubbing direction of the alignment layer additionally disposed on the liquid crystal display, a wide viewing-angle mode and a narrow viewing-angle mode can be provided. As shown in FIG. 3A, under the narrow viewing-angle mode, the front view observer can see the displayed image 300 while the side-view observer cannot distinguish the displayed image 300 because a specific picture 310 having alternate bright and dark squares covers the image 300 as shown in FIG. 3B. By doing so, the viewing-angle adjusting purpose can be achieved.

However, as shown in the above-mentioned three examples, the present viewing-angle adjustable liquid crystal display structures have the disadvantage of the luminance and bright contrast deviation as the viewing angle modes are switched. Also they cannot provide the narrow viewing-angle mode for users at other viewing-angles except the front view ones. Therefore, such viewing-angle adjusting methods are not satisfied.

SUMMARY OF THE INVENTION

It is therefore an object of the invention to provide a viewing-angle adjustable liquid crystal display and method for adjusting viewing angle of the same. Each pixel includes two sub-pixels, driven by two thin film transistors respectively, and the turning angles of liquid crystals corresponding to the two driven sub-pixels are different from each other by 180 degrees. Under the wide viewing-angle mode, the two sub-pixels in each pixel are driven with the same driving voltage while under the narrow viewing-angle mode, one sub-pixel in each pixel is driven to be in a dark mode and the other sub-pixel is driven to be in a normal mode. Therefore, the viewing-angle adjusting purpose can be achieved.

The invention achieves the above-identified object by providing a viewing-angle adjustable liquid crystal display including a display panel and a data driver. The display panel includes several pixel units, and each pixel unit includes a first sub-pixel and a second sub-pixel. The data driver is for respectively providing a first driving voltage to the first sub-pixel and a second driving voltage to the second sub-pixel. When the liquid crystal display is operated in a wide viewing-angle mode, the first driving voltage and the second driving voltage corresponding to each pixel unit are substantially equal to a pixel voltage, and when the liquid crystal display is operated in a narrow viewing-angle mode, the first driving voltages and the second driving voltages corresponding to one portion of the pixel units are substantially equal to a gray-level voltage and the pixel voltage respectively while the second driving voltages and the first driving voltages corresponding to the other portion of the pixel units are substantially equal to the gray-level voltage and the pixel voltage respectively.

The invention achieves the above-identified object by providing a method for adjusting viewing angle of a liquid crystal display viewing-angle. The method includes driving the first sub-pixel and the second sub-pixel of each pixel unit with a pixel voltage in response to a wide-viewing-angle-mode signal; and driving the first sub-pixels and the second sub-pixels of one portion of the pixel units with a gray-level voltage and the pixel voltage, respectively, in response to a narrow-viewing-angle-mode signal; and driving the second sub-pixels and the first sub-pixels of the other portion of the pixel units with the gray-level voltage and the pixel voltage, respectively, in response to a narrow-viewing-angle-mode signal.

Other objects, features, and advantages of the invention will become apparent from the following detailed description of the preferred but non-limiting embodiment. The following description is made with reference to the accompanying drawings.

DETAILED DESCRIPTION OF THE INVENTION

Figure 1:
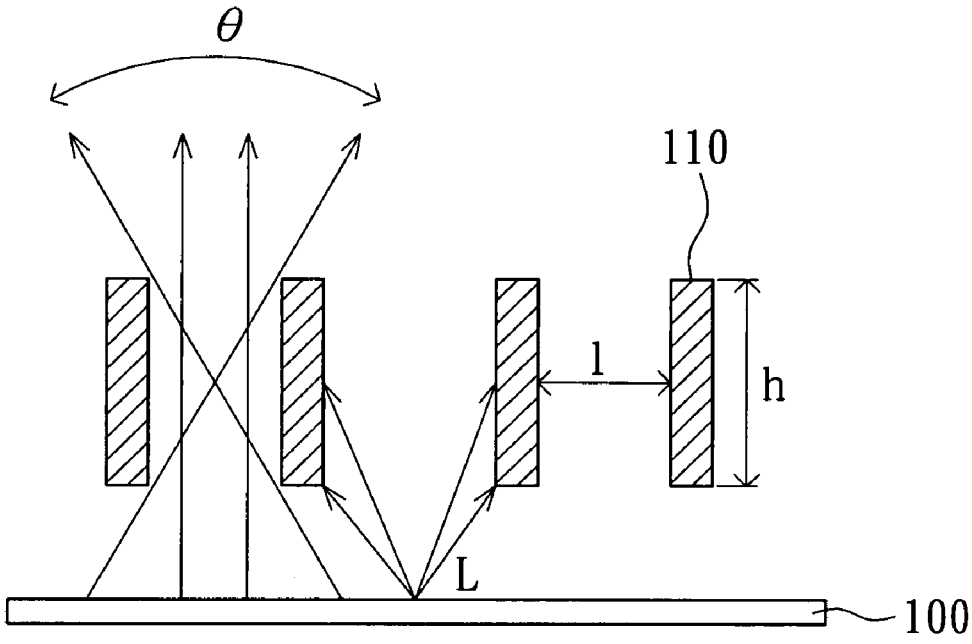
FIG. 1(RELATED ART)
FIG. 1 (Related Art) is a schematic diagram of using shutter structure to adjust the liquid crystal display viewing-angle.
Figure 2B:
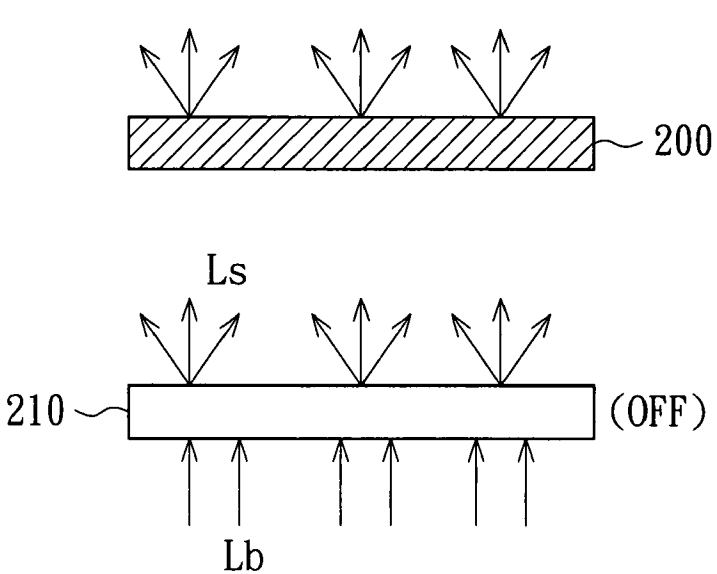
FIG. 2B(RELATED ART)
FIG. 2A and FIG. 2B (Related Art) are schematic diagrams of using a light scattering device to adjust the liquid crystal display viewing-angle.
Figure 2A:
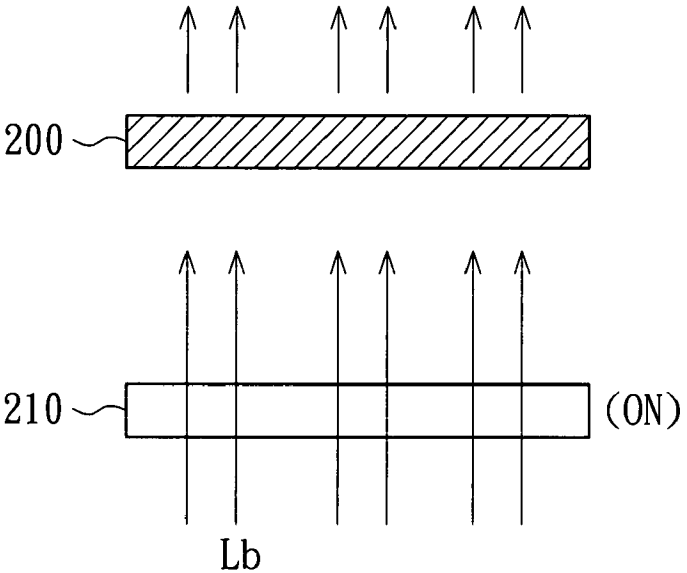
FIG. 2A(RELATED ART)
Figure 3A:
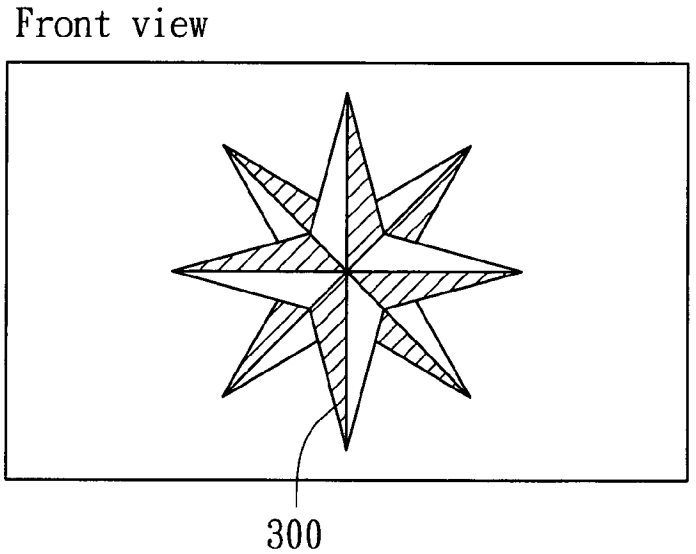
FIG. 3A(RELATED ART)
FIG. 3A and FIG. 3B (Related Art) are schematic diagrams of controlling viewing angles by using an extra alignment layer.
Figure 3B:
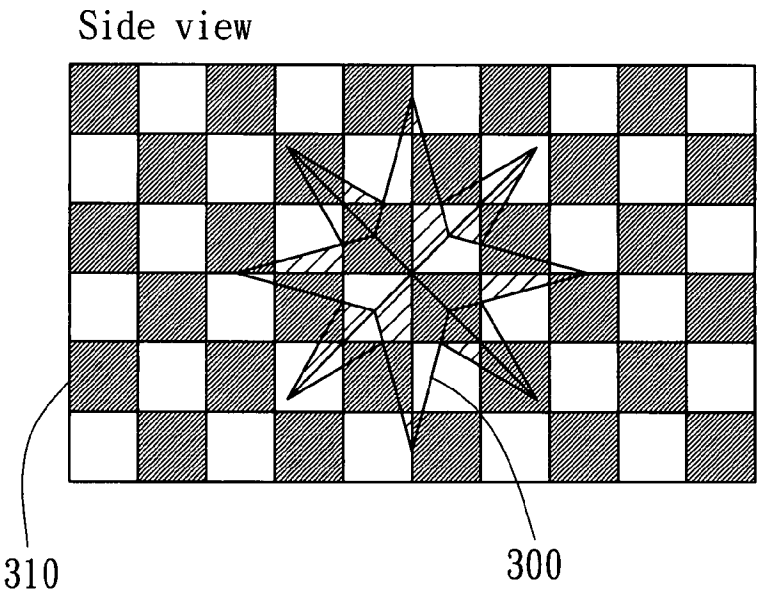
FIG. 3B(RELATED ART)
Figure 4A:
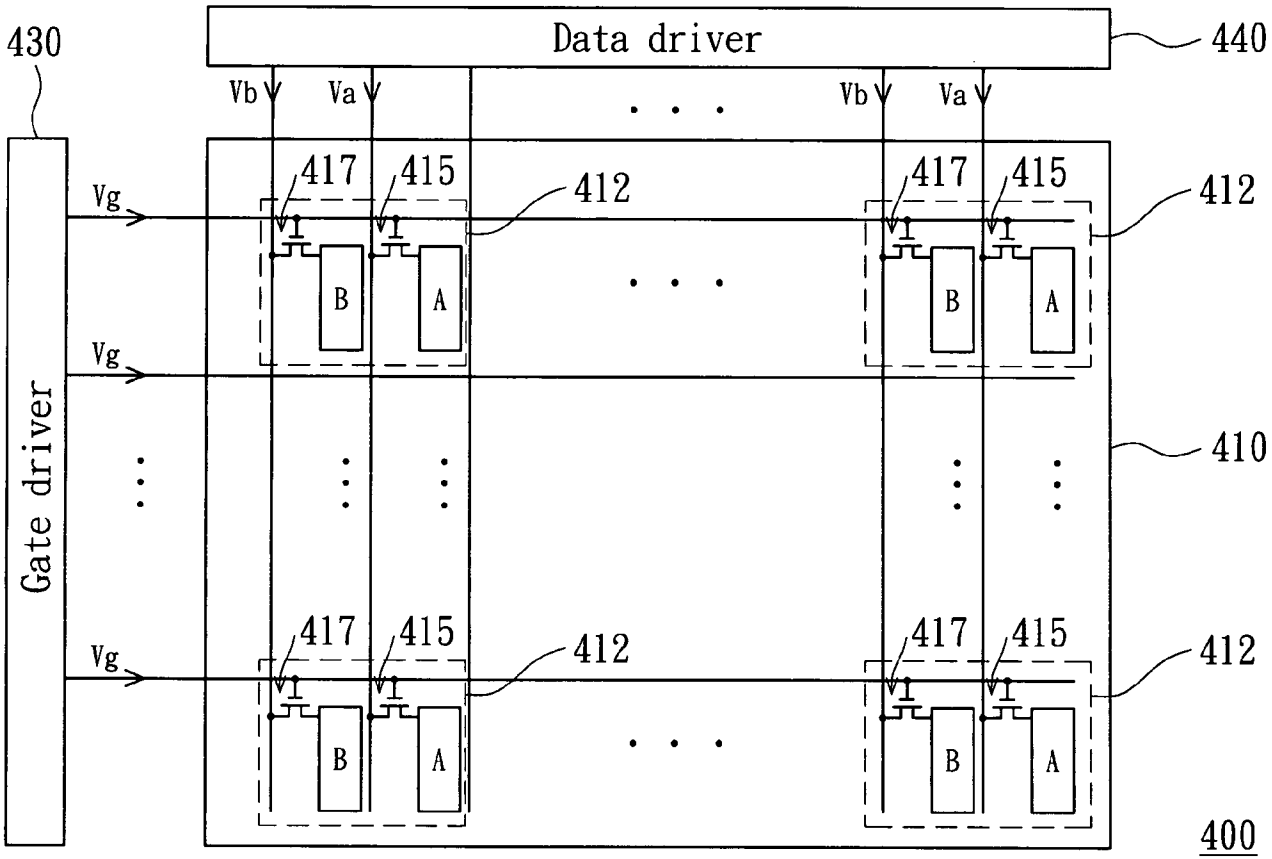
FIG. 4A is a vertical-view diagram of a liquid crystal display according to a preferred embodiment of the invention.
Figure 4B:
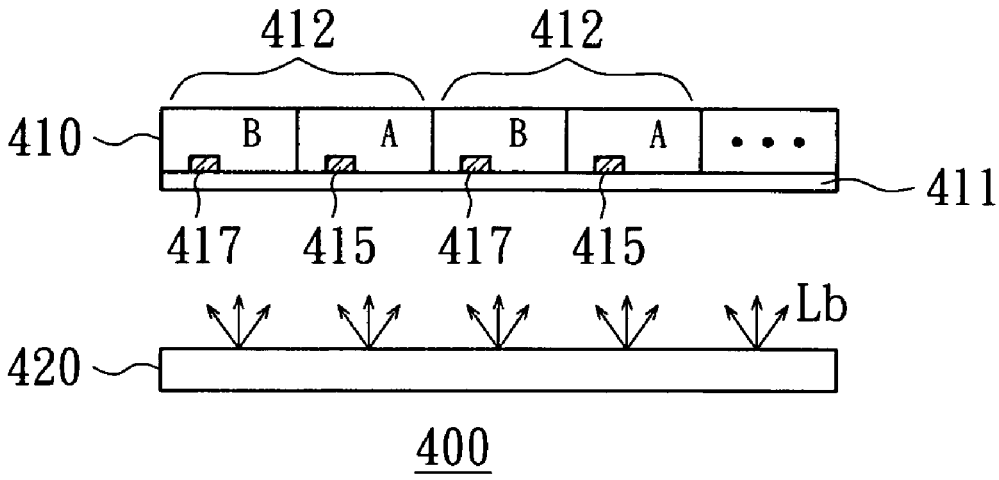
FIG. 4B is a schematic partial cross-sectional view of a liquid crystal display according to a preferred embodiment of the invention.
Figure 4C:
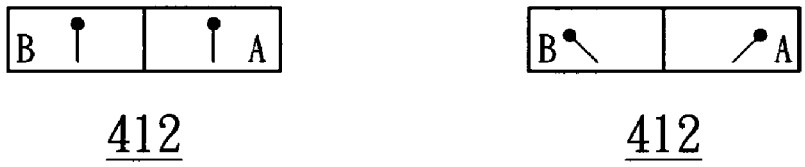
FIG. 4C is a schematic diagram of liquid crystals in a sub-pixel driven with a pixel voltage and a gray-level voltage according to the embodiment of the invention.

FIG. 4A is a vertical-view diagram of a liquid crystal display according to a preferred embodiment of the invention. FIG. 4B is a schematic partial cross-sectional view of a liquid crystal display according to a preferred embodiment of the invention. FIG. 4C is a schematic diagram of liquid crystals in a sub-pixel respectively driven with a pixel voltage and a gray-level voltage according to the embodiment of the invention. Referring to FIG. 4A, FIG. 4B, and FIG. 4C at the same time, the liquid crystal display 400 includes a display panel 410, a backlight module 420, a gate driver 430, and a data driver 440. The display panel 410 includes a substrate 411 and a number of pixel units 412 formed on the substrate 411. Each pixel unit includes a first sub-pixel A and a second sub-pixel B, respectively coupled to thin film transistors 415 and 417. For example, the liquid crystal display of resolution 1024×768 has ((1024×3×2)×768) thin film transistors. The thin film transistors 415 and 417 are switched on by the output voltage Vg of the gate driver 430 to respectively output the driving voltage Va and Vb from the data driver 440 to the sub-pixels A and B. The driving voltage can be a normal pixel voltage, such as 5V, or a gray-level voltage, such as 0V, for respectively actuating the sub-pixel A or B to be in display mode and dark mode. Moreover, the backlight module 420 is used to provide backlight Lb to the display panel 410.

The vertical alignment (VA) liquid crystal display is taken as an example in the following description. In terms of each pixel unit 412, when the driving voltages Va and Vb input to the sub-pixels A and B from thin film transistors 415 and 417 are substantially equal to a gray-level voltage, such as 0V, the sub-pixels A and B are set in dark mode and liquid crystals in the sub-pixels A and B are in a stand-upright state as shown in the left figure of FIG. 4C. When the driving voltages Va and Vb input to the sub-pixels A and B from the thin film transistors 415 and 417 are substantially equal to a normal pixel voltage, such as 5V, the sub-pixels A and B are set in display mode, the liquid crystals in the sub-pixels A and B turn to the horizontal direction due to the electrical field, and liquid crystals in sub-pixels A and B turn to two different sides as shown in the right figure of FIG. 4C.

Figure 4D:
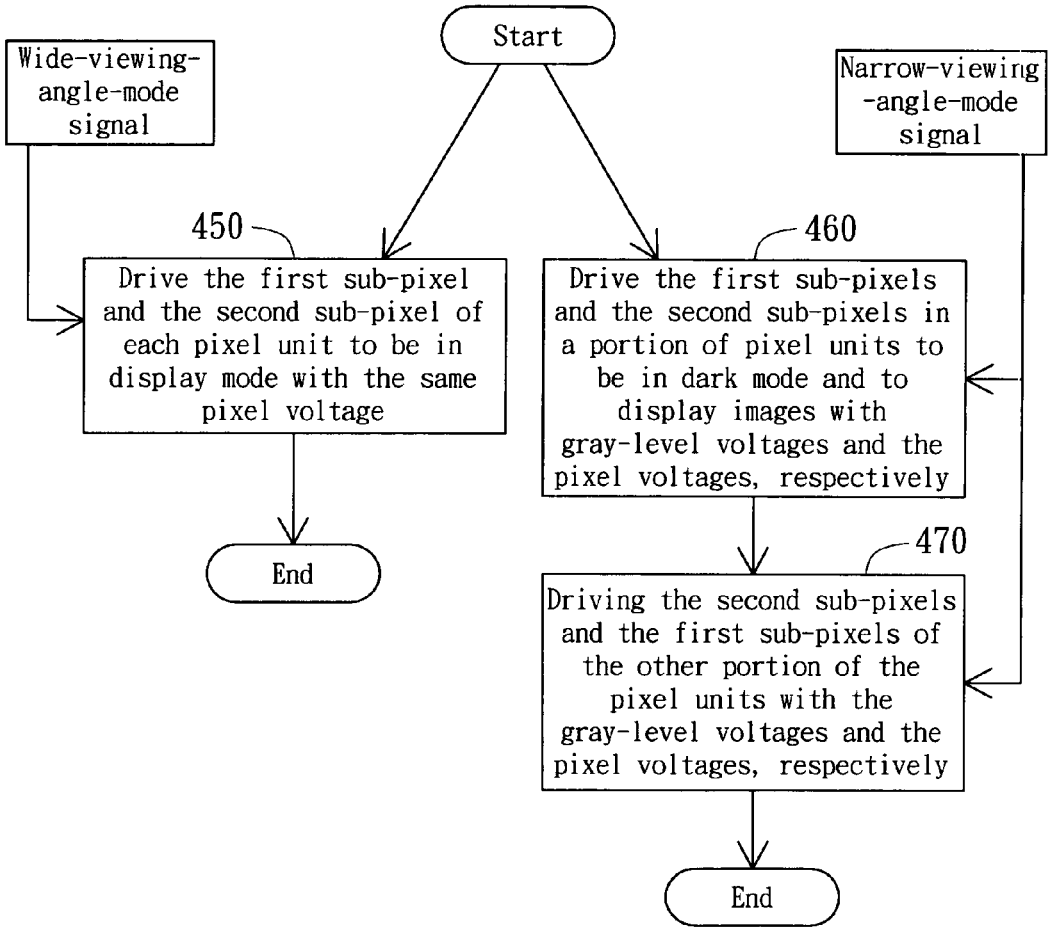
FIG. 4D is a flow chart of the method for adjusting viewing angle of the liquid crystal display according to a preferred embodiment of the invention.

Referring to FIG. 4D, a flow chart of the method for adjusting viewing angle of the liquid crystal display according to a preferred embodiment of the invention is shown. First, in step 450, the first sub-pixel A and the second sub-pixel B of each pixel unit 412 are driven to be in display mode with the same pixel voltage in response to a wide-viewing-angle-mode signal. Subsequently, in step 460, as shown in FIG. 4F, the first sub-pixels A and the second sub-pixels B in a portion of pixel units 412, such as the left-half portion of the display panel 410, are driven to be in dark mode and to display images with gray-level voltages (Va=G) and the above-mentioned pixel voltages (Vb=P), respectively, in response to a narrow-viewing-angle-mode signal, and in step 470, the first sub-pixels A and the second sub-pixels B of the other portion of pixel units, such as the right-half portion of the display panel 410, are driven to display images and to be in dark mode with the pixel voltages (Va=P) and the gray-level voltages (Vb=G), respectively, in response to the narrow-viewing-angle-mode signal.

Figure 4E:
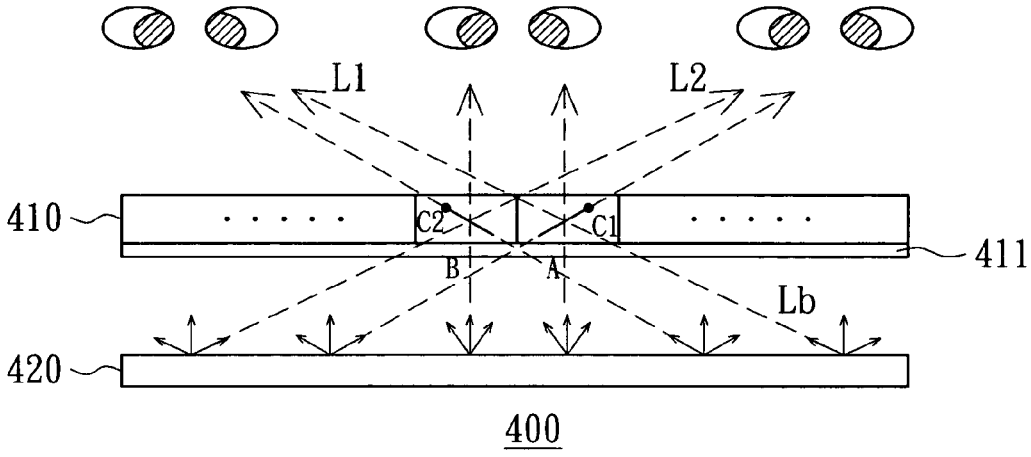
FIG. 4E is a schematic cross-sectional view of the liquid crystal display operated in the wide viewing-angle mode in FIG. 4B.
Figure 4F:
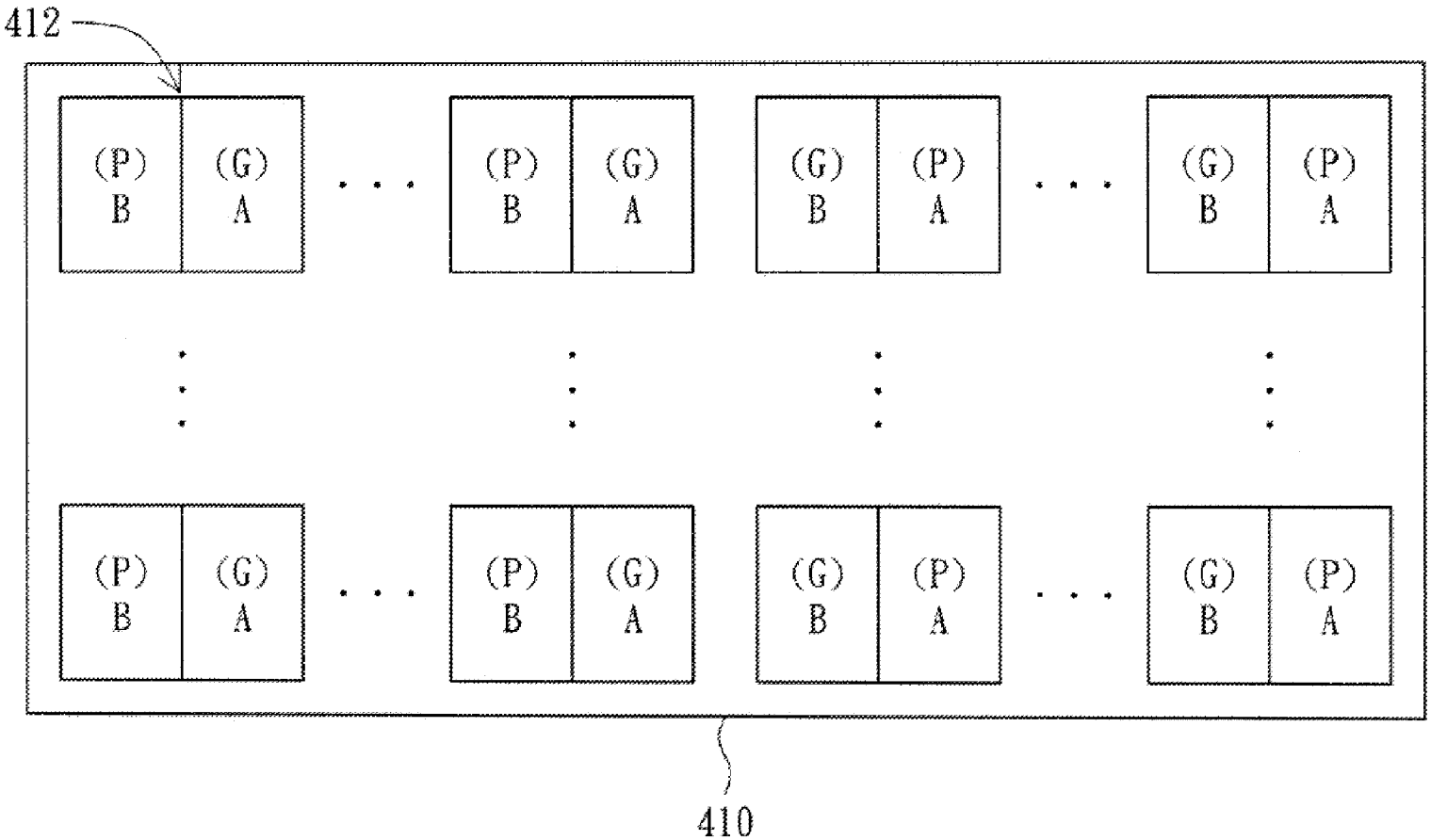
FIG. 4F is a schematic diagram of a driving condition of the pixel units on the display panel in FIG. 4A in response to a narrow-viewing-angle-mode signal.

Referring to FIG. 4E, a schematic cross-sectional view of the liquid crystal display operated in the wide viewing-angle mode in FIG. 4B is shown. When the liquid crystal display 400 is operated in the wide viewing-angle mode, the sub-pixels A and B in each pixel unit 412 are switched on by the same pixel voltage and set in display mode. Therefore, the liquid crystals in sub-pixels A and B respectively turn to two different sides. In terms of the front-view observer, the backlight Lb can pass the liquid crystal C1 of the first sub-pixel A and the liquid crystal C2 of the second sub-pixel B to enter the observer's eyes. As a result, the front-view observer can see images on the display panel 410 very clearly. In terms of two-side view observers, the partial backlight L1 and L2 can respectively pass the liquid crystals C1 and C2 by a specific included angle and reaches the left-side view and right-side view observers' eyes. The gray-level reverse effect will not take place, so the side-view observers can see the displayed images clearly.

Obviously, the above-mentioned wide viewing-angle mode operation is not limited to the arrangement of the sub-pixels A and B. When the sub-pixels A and B are arranged in reverse order, since the sub-pixels A and B in each pixel unit 412 are driven in display mode, the backlight Lb can still reach the eyes of observers at various viewing angles, thereby achieving the wide viewing-angle mode purpose.

Figure 5:
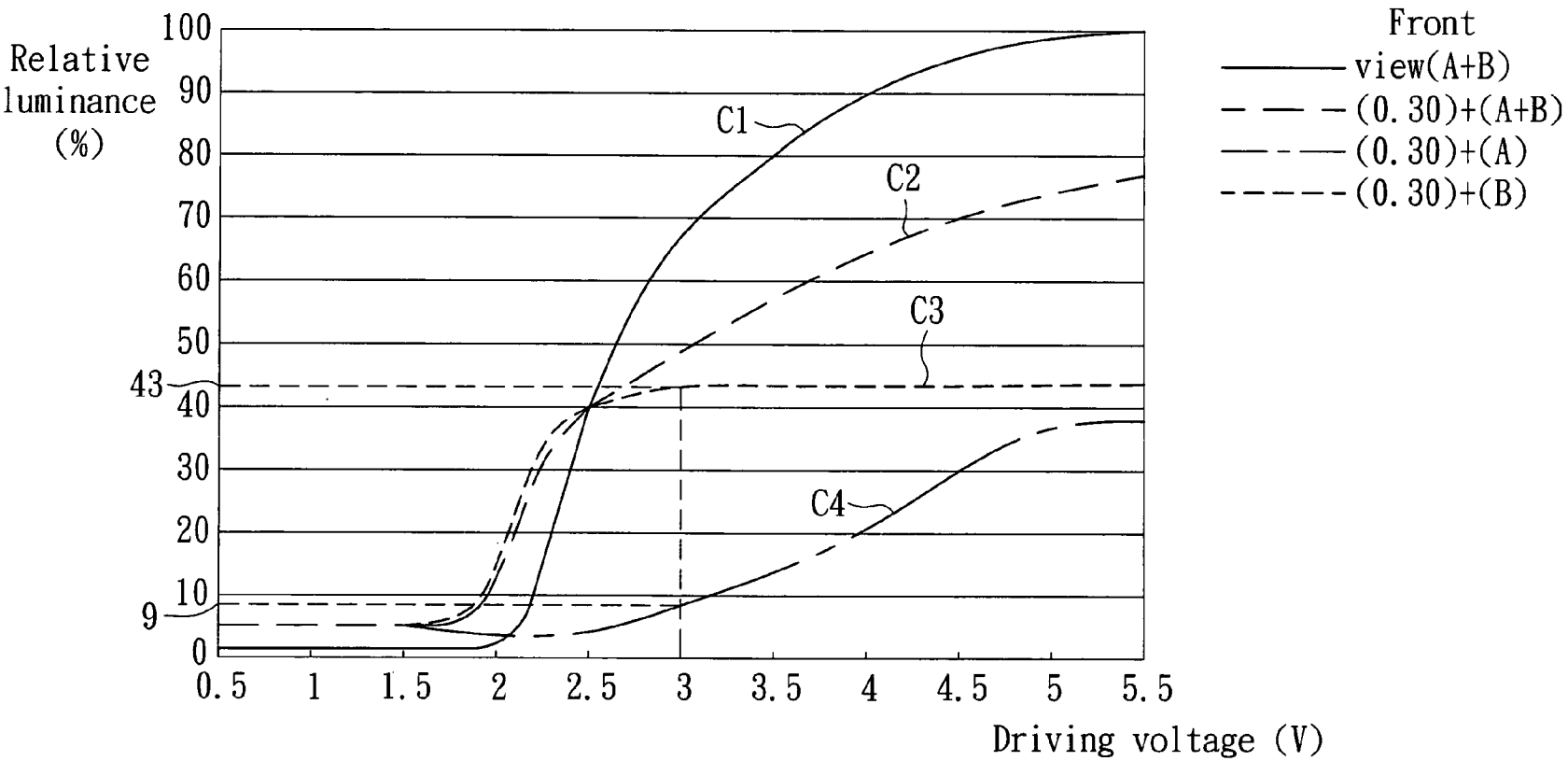
FIG. 5 illustrates four relative curves between the pixel voltage (V) and the display luminance (%) of the display panel observed at a front view and a 30-degree right inclination view in the wide viewing-angle mode with the sub-pixels A and B driven with the same pixel voltage.

The curves C1 and C2 in FIG. 5 respectively illustrate the relative curves between the pixel voltage (V) and the display luminance (%) of the display panel 410 observed at a front view and a 30-degree right inclination view in the wide viewing-angle mode with the sub-pixels A and B driven with the same pixel voltage. Although the display luminance and bright contrast observed at 30-degree right inclination view is lower than that observed at front view, the gray-level reverse effect will not take place.

Figure 6A:
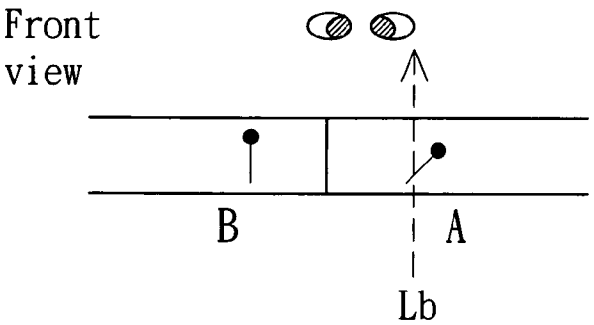
FIGS. 6A~6D are schematic views of observing the liquid crystal display in FIG. 4B operated in the narrow viewing-angle mode with one of the sub-pixels A and B set in display mode and the other set in dark mode at front view and at side view.
Figure 6B:
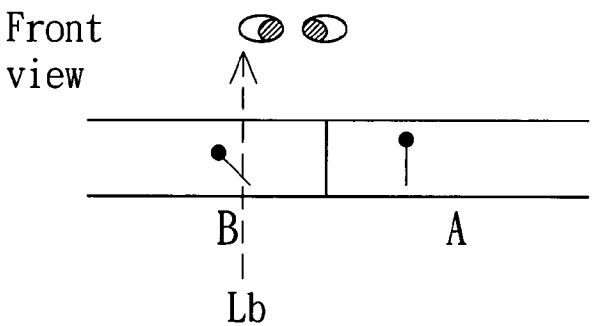
Figure 6C:
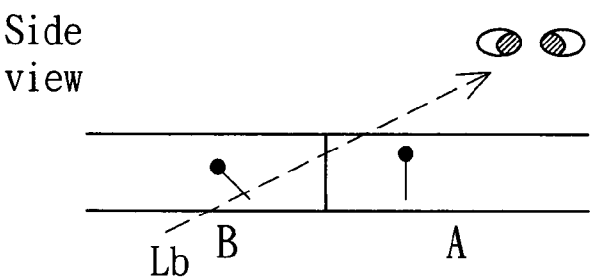
Figure 6D:
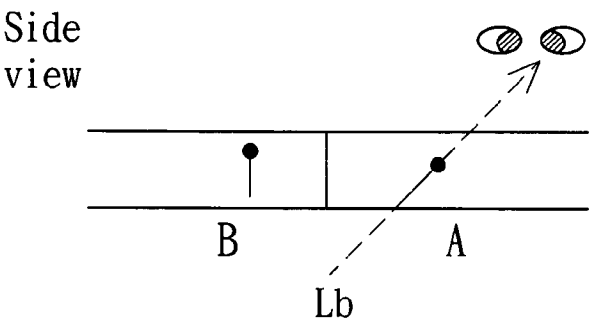

Referring to FIGS. 6A~6D, schematic views of observing the liquid crystal display in FIG. 4B operated in the narrow viewing-angle view with one of the sub-pixels A and B set in display mode and the other set in dark mode at front view and 30-degree right inclination view are shown. When the liquid crystal display 400 is operated in the narrow viewing-angle mode, one of the sub-pixels A and B has to be driven in dark mode with liquid crystals standing upright while the other driven to display images with the pixel voltage. No matter the sub-pixel A or B is in dark mode, the front-view observer will not sense any difference for the backlight phase delay in the two situations is the same in terms of the front-view observer as shown in FIG. 6A and FIG. 6B. When the sub-pixel A is set in dark mode and the sub-pixel B is set in display mode as shown in FIG. 6C, for the backlight Lb can pass liquid crystals in the sub-pixel B at a specific included angle and reach the eyes of observers at 30-degree right inclination view. Therefore, the observers at 30-degree right inclination view can see the displayed images. As shown by the curve C3, when the driving voltage is 3V, the relative display luminance is about 43%. However, when the sub-pixel A is set in display mode and the sub-pixel B is set in dark mode, as shown in FIG. 6D, the backlight Lb enters the sub-pixel A in a parallel direction before received by the eyes of observers at 30-degree right inclination view. Therefore the gray-level reverse effect takes place so that the right-side view observer cannot clearly see the displayed images. As shown by the curve C4, when the driving voltage is 3V, the relative display luminance T is only 9%.

As mentioned above, observers at 30-degree right inclination view will observe different display luminance for the transmission rate of the backlight Lb is different in two above-mentioned methods of setting the sub-pixels A and B in display mode and dark mode while the front-view observer will observe the same display luminance. Therefore, the viewing-angle adjusting mechanism can be provided.

Especially, the above-mentioned narrow viewing-angle mode operation is not limited to the arrangement of the sub-pixels A and B as shown in FIG. 6. When the sub-pixels A and B are arranged in reverse order, the front-view observer can still observe one of the sub-pixels in each pixel unit in dark mode and the other in display mode. The 30-degree right inclination view observer can still observe one sub-pixel of each pixel unit in dark mode and the received backlight Lb still passes the other sub-pixel at a specific included angle or in approximate parallel. Therefore, it will not influence the display luminance observed by observers at front view and at 30-degree right inclination view.

Figure 7:
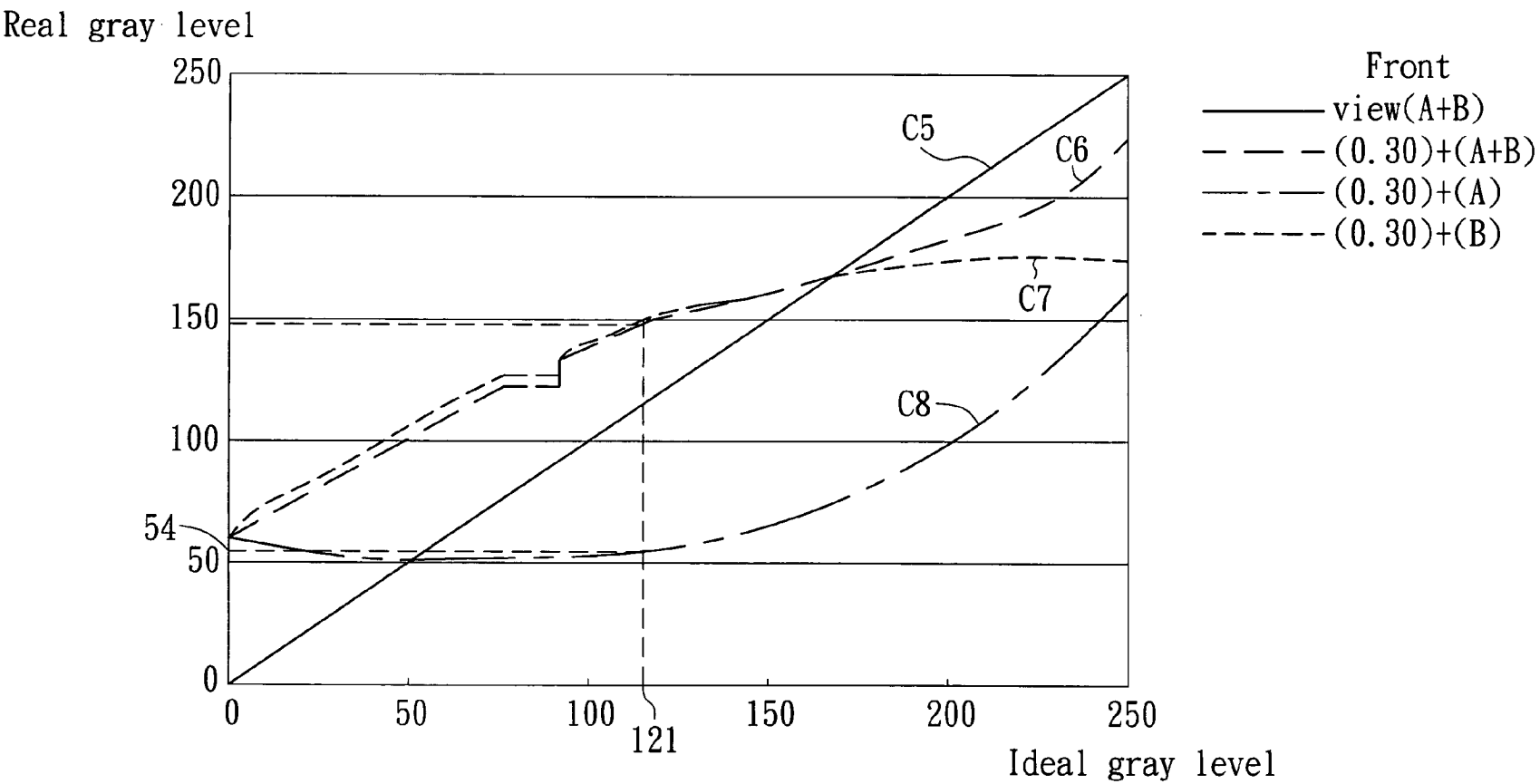
FIG. 7 is the relative diagram between the ideal gray level and the observed gray level corresponding to FIG. 5.

Referring to FIG. 7, the relative diagram between the ideal gray level and the observed gray level corresponding to FIG. 5 is shown. The X-axis represents the ideal gray level generated by driving voltages and the Y-axis represents the actual gray level sensed by the observer. The curve C5 shows that the actual gray level sensed by the front-view observer is the same with the ideal gray level as the sub-pixels A and B are driven in display mode. As shown by the curve C6, the actual gray level sensed by the observer at 30-degree right inclination view is not quite different from the ideal gray level. However, as shown by the curves C7 and C8, for example, the driven gray level is 121, when the sub-pixel B is set in display mode, the observer at 30-degree right inclination view will sense the gray level 150 while when only the sub-pixel A is set in display mode, the observer at 30-degree right inclination view will sense the gray level 54. Therefore, when only the sub-pixels A of a portion of pixel units are driven in display mode (or the dark mode), and only the sub-pixels B of the rest pixel units 412 are driven in display mode (or the dark mode), the side-view observers will see the different images while the front-view observer can see the correct displayed images.

The liquid crystal display 400 of the invention as operated at the narrow viewing-angle mode, is not limited to that the first sub-pixels A of one portion of pixel unit 412 and the second sub-pixels B of the other portion of pixel units 412 are driven with the gray-level voltage. Other driving methods can be also used, for example, only the first sub-pixels of the first portion of pixel units 412 and the second sub-pixels of the second portion of pixel units 412 are driven by the gray-level voltage while the first and the second sub-pixels of the rest pixel units 412 are driven in display mode. Since one kind of sub-pixels of a portion of pixel units are driven in dark mode, the front-view and the side-view observers will observe displayed images of different luminance, thereby achieving the narrow viewing-angle mode purpose, it will not be apart from the scope of skills in the invention.

Moreover, when the narrow viewing-angle mode is operated, because the display panel 410 has a half area driven in dark mode, the display luminance will be reduced. The operation current of the backlight module 420 under the narrow viewing-angle mode can be increased to provide the same display luminance with that in the wide viewing-angle mode. Therefore, users will not feel apparent display luminance deviation between the two modes.

As described above, although the vertical alignment liquid crystal display is taken as an example in the invention, the liquid crystal display of the invention can be also a twisted nematic (TN) display. Since each pixel unit can be divided into two independent sub-pixels, the two sub-pixels are driven in display mode in wide viewing-angle mode, and one kind of sub-pixels of a portion of pixel units are driven in dark mode in narrow viewing-angle mode, the front-view observer can see the displayed images while the side-view observer cannot see the images clearly, thereby achieving the viewing-angle adjusting purpose. Therefore, it is still not apart from the skill scope of the invention.

The liquid crystal display disclosed by the above-mentioned embodiment has the following advantages. The pixel units are divided into sub-pixels A and B driven by two different thin film transistors. The wide and the narrow viewing-angle modes can be provided by respectively driving the two sub-pixels of each pixel unit in display mode and driving the sub-pixel A or B of a portion of the pixel units in dark mode. Especially, under the narrow viewing-angle mode, the number and location of the pixel units in which only the sub-pixels A or B are driven in dark mode can be selectively adjusted so that the observers at some viewing angles cannot see the displayed images. Therefore, no extra device is needed to be disposed on the display and the actual viewing-angle adjusting purpose can be achieved.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A viewing-angle adjustable liquid crystal display, comprising:

a display panel having a plurality of pixel units, each pixel unit comprising a first sub-pixel and a second sub-pixel; and a data driver for providing a first driving voltage to the first sub-pixel and a second driving voltage to the second sub-pixel, respectively;

wherein when the liquid crystal display is operated in a wide viewing-angle mode, the first driving voltage and the second driving voltage corresponding to each pixel unit are substantially equal to a pixel voltage, and when the liquid crystal display is operated in a narrow viewing-angle mode, the first driving voltages and the second driving voltages corresponding to the pixel units in one portion of the display panel are substantially equal to a gray-level voltage and the pixel voltage, respectively, while the second driving voltages and the first driving voltages corresponding to the pixel units in another portion of the display panel are substantially equal to the gray-level voltage and the pixel voltage, respectively.

2. The liquid crystal display according to claim 1, wherein the first sub-pixel comprises a first thin film transistor and the second sub-pixel comprises a second thin film transistor.

3. The liquid crystal display according to claim 1, further comprising a backlight module, wherein the operational current of the backlight module in the narrow viewing-angle mode is higher than the operational current of the backlight in the wide viewing-angle mode.

4. A method for adjusting viewing-angle of a liquid crystal display, the liquid crystal display comprising a display panel having a plurality of pixel units, each pixel unit having a first sub-pixel and a second sub-pixel, the method comprising:

driving the first sub-pixel and the second sub-pixel of each pixel unit with a pixel voltage in response to a wide-viewing-angle-mode signal;

driving the first sub-pixels and the second sub-pixels of the pixel units in one portion of the display panel with a gray-level voltage and the pixel voltage, respectively, in response to a narrow-viewing-angle-mode signal; and driving the second sub-pixels and the first sub-pixels of pixel units in another portion of the display panel with the gray-level voltage and the pixel voltage, respectively, in response to the narrow-viewing-angle-mode signal.

5. The method according to claim 4, wherein the pixel voltage is higher than the gray-level voltage.

6. The method according to claim 4, wherein the gray-level voltage is about 0V.

7. The method according to claim 4, wherein the pixel voltage is about 5V.

* * * * *